US008381455B2

(12) United States Patent
Schooley

(10) Patent No.: US 8,381,455 B2
(45) Date of Patent: Feb. 26, 2013

(54) TOOL FREE TRANSITIONAL SHELTER

(76) Inventor: Frank W. Schooley, Matlacha, FL (US)

( * ) Notice: Subject to any disclaimer, the term of this patent is extended or adjusted under 35 U.S.C. 154(b) by 0 days.

(21) Appl. No.: 12/807,510

(22) Filed: Sep. 7, 2010

(65) Prior Publication Data

US 2012/0055101 A1 Mar. 8, 2012

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |

(52) U.S. Cl. ..... 52/79.9; 52/79.5; 446/122

(58) Field of Classification Search ..... 52/79.9, 52/79.1, 79.4, 79.5; 446/108, 109, 122, 124; 403/315–320, 401, 402

See application file for complete search history.

(56) References Cited

U.S. PATENT DOCUMENTS

| | | | | | |
|---|---|---|---|---|---|
| 2,331,754 | A * | 10/1943 | Wohlers | 229/148 |
| 3,591,212 | A * | 7/1971 | Rhyne | 217/65 |
| 3,664,011 | A * | 5/1972 | Labastrou | 144/347 |
| 4,454,678 | A * | 6/1984 | Duvivier | 446/112 |
| 4,815,242 | A * | 3/1989 | Gilliland | 52/93.1 |
| 5,281,185 | A * | 1/1994 | Lee | 446/488 |
| 5,351,453 | A * | 10/1994 | Leslie | 52/270 |
| 5,454,331 | A * | 10/1995 | Green | 108/180 |
| 5,823,531 | A * | 10/1998 | Huber | 273/156 |
| 6,272,796 | B1 * | 8/2001 | Metzler | 52/93.1 |
| 6,711,860 | B2 * | 3/2004 | Fleishman | 52/81.3 |
| 7,922,556 | B2 * | 4/2011 | Schreff et al. | 446/93 |

* cited by examiner

*Primary Examiner* — Brian Glessner
*Assistant Examiner* — Paola Agudelo

(57) ABSTRACT

A modular shelter comprising a first side wall, first end wall, second side wall, second end wall, first roof section, and a second roof section cut from stock material, such that: (a) the first side wall and the first end wall, the first end wall and the second side wall, the second side wall and the second end wall, and the second end wall and the first side wall are disposed at an angle between 60 and 120 degrees relative to one another and are connected by at least two mortise and tenon joints; and (b) the first roof section and the second roof section are disposed at an angle between 45 and 180 degrees relative to one another and are connected by at least two mortise and tenon joints; wherein the components of the mortise and tenon joints are created using one tool resulting in a novel joint.

6 Claims, 8 Drawing Sheets

TOOL FREE TRANSITIONAL SHELTER

FIELD OF THE INVENTION

The instant invention relates to a modular structure that can be easily assembled and taken down which includes a plurality of panels which are connected by interlocking finger joints and are further secured by a plurality of unique mortise and tenon joints. The present invention is particularly, but not exclusively, useful in disaster relief efforts, military applications, as well as any other application in which a portable modular structure which can be easily assembled and taken down without the use of specialized tools is desired.

BACKGROUND OF THE INVENTION

Modular transportable shelters are useful for a variety of purposes including, for example, housing, storage, work space, and protection from the elements. Providing a modular transportable shelter permits one to easily transport, assemble and disassemble a shelter in an area where shelter may not be available, such as a military field or an area that was affected by a natural disaster, such as a hurricane or typhoon, for example. It is also desirable that such shelters do not need specialized tools for assembly and disassembly as such tools are often unavailable in the areas described above, and would also likely require intensive labor efforts or specialized skilled laborers.

While there are various shelters available which can be easily assembled and disassembled, such shelters often fail to maintain a secure shelter. Indeed, the shelters known in the art are often not sturdy enough to sustain the force of gravity, wind, rain, etc. post-assembly. Such shelters are likely to collapse without warning, thus creating a hazard to those within the shelter. Shelters known in the art which can actually withstand the force of gravity, wind, rain, etc. post-assembly are typically very complex, making them difficult to assemble, often requiring specialized tools and/or labor.

Known in the art are prefabricated post and beam shelters which incorporate a plurality of posts and beams. See, for example, U.S. Pat. No. 4,815,242 to Gilliland. However, such post and beam shelters require many parts to the form the post and beam frame system and require some sort of additional structure to cover the open spaces created by the post and beam frame system, which often result in an unnecessarily heavy shelter, which can be difficult to adequately support. Indeed, shelters using post and beam frame systems require many posts as such posts must be displaced a small distance from one another.

Heretofore unknown is a shelter which can be easily assembled and taken down which includes a plurality of panels which are connected by interlocking finger joints and are further secured by a plurality of unique mortise and tenon joints, so as to create a shelter which is adequately supported. It is therefore an object of the instant invention to provide a shelter which is easily assembled and disassembled, and adequately supported by a plurality of wall and roof panels which are connected by interlocking finger joints and are further secured by a plurality of unique mortise and tenon joints.

A mortise is a aperture or slot cut into any type of material or stock. A tenon is a projection, typically on one end of any type of material or stock, which is inserted into a mortise. The length and width of the tenon is typically less than the than length and width of the mortise in which the tenon is disposed. When the tenon is inserted into the mortise, a mortise and tenon joint is formed. Mortise and tenon joints have been used for centuries to join separate members to one another.

Mortise and tenon joints are some of the strongest joints known and can be used for a wide variety of purposes.

Conventional mortise and tenon joints incorporate a mortise which mates exactly with the tenon. In other words, the tenon fills the mortise completely, leaving no gaps or space between the mortise and tenon once the tenon is inserted into the mortise. Creating a tenon that fits intimately within a mortise typically involves reducing the size of the tenon so that the tenon is the same size as the mortise in which the tenon is inserted.

The mortise and tenon are typically disposed such that the tenon forms a 90 degree angle with respect to the mortise in which the tenon is inserted. It is known in the art that forming a joint in which the tenon forms a 90 degree angle with respect to the mortise in which the tenon is inserted, results in a strong joint, and is hence typically desirable. However, one may desire to attach a mortise and tenon at various angles, depending on the user's specific requirements. In order to attach one material to another material at different angles of attachment, the shoulder of the mortise may be beveled such that the tenon may be inserted into the mortise at the angle desired. Whether the mortise and tenon are at a 90 degree angle with respect to one another, or any other angle, once the tenon is inserted into the mortise, the resulting mortise and tenon joint can be secured by fastening one member to the other using bolts, nails, wedges or other fasteners.

Mortise and tenon joints may be secured using a conventional dovetail joint. Such mortise and tenon joints may be secured (or locked into place) using a dovetail joint in which one or more pins extend from the end of one member, and interlock with one or more tails cut into the end of a separate member, thus joining the two members. See, for example, U.S. Pat. No. 187,962 to Cantrell; and U.S. Pat. No. 3,591,212 to Rhyne. As such, mortise and tenon joints may be secured (or locked into place) using a dovetail aperture or slot across a tenon and a wedge of similar dovetail cross-section such that the dovetail cross-section is contained within the dovetail aperture when the tenon is inserted into the mortise. In other words, when the tenon is inserted into the mortise, the wedge is moved along the dovetail aperture until it is firmly engaged within the dovetail aperture so as to lock the two members together and prevent them from separating until the wedge is removed. See, for example, U.S. Pat. No. 4,492,489 to Kantorowich and U.S. Pat. No. 4,867,598 to Winter IV. Known in the art are mortise and tenon dovetail joints which avoid the protrusion of the tenon beyond the mortise by incorporating a tenon which is shorter than the width of the material in which the mortise is cut (sometimes referred to as a stub tenon). See, for example, U.S. Pat. No. 1,093,023 to Alta; and U.S. Pat. No. 2,614,302 to Johnson.

Mortise and tenon joints may also be secured through means other than a dovetail joint. For example, a mortise and tenon joint in which one material has two mortises and another material has two tenons, may be locked together by inserting the tenons into the mortises and rotating the former. U.S. Pat. No. 3,009,719 to Otto, et al. Alternatively, a mortise and tenon joint may include a self-locking plate on each of the two members to be attached so as to secure the mortise and tenon joint after the tenon is inserted into the mortise. U.S. Pat. No. 4,797,020 to Winston. Further, a mortise and tenon joint may be fastened after the tenon is inserted into the mortise by a locking means, such as a pin or dowel which extends through each of the two members to be attached, which fastens the two members. U.S. Pat. No. 4,916,881 to Gilliand; U.S. Pat. No. 6,272,796 to Metzler.

Mortises and tenons can be cut using a variety of tools, including both hand tools and power tools. For example, a tenon can be made using a hand saw or with a radial arm saw or table saw with a tenoning jig; while a mortise may be cut using a router, drill press, or mortising machine.

Conventional mortise and tenon joints are constructed of various materials, each having different characteristics, such as thickness, size, hardness, and specific gravity, thus requiring a plurality of tools to conform each component of the mortise and tenon joint to the desired size and shape.

Heretofore unknown is a mortise and tenon joint in which all the components of the joint can be cut or simply formed using a Computer Numerical Controlled Router (CNC Router) or similar device using a rotary cutting tool. It is therefore an object of the instant invention to provide a mortise and tenon joint in which all components of the joint are formed using a Computer Numerical Controlled Router (CNC Router) or similar device using a rotary cutting tool, which can then be assembled without the use of specialized tools.

Conventional mortise and tenon joints are assembled using a plurality of tools, since conventional mortise and tenon joints typically constructed of various materials, each having different characteristics, such as thickness, size, hardness, and specific gravity. It is an object of the instant invention to provide a shelter which can be assembled and disassembled without the use of specialized tools or extensive labor.

Other objects of the instant invention will be observable through a complete study of the specification, drawings and claims herein. Objects of the instant invention are provided as examples and are not intended to be limitive of the scope of the protection herein.

SUMMARY OF THE INVENTION

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

The present invention relates to a modular shelter comprising a first side wall, a first end wall, a second side wall, a second end wall, a first roof section, and a second roof section cut from a stock material, such that: (a) the first side wall and the first end wall, the first end wall and the second side wall, the second side wall and the second end wall, and the second end wall and the first side wall are disposed at an angle between 60 and 120 degrees relative to one another and are connected by at least two mortise and tenon joints; and (b) the first roof section and the second roof section are disposed at an angle between 45 and 180 degrees relative to one another and are connected by at least two mortise and tenon joints. The mortise and tenon joints which connect the first side wall and the first end wall, the first end wall, the second side wall, the first roof section and the second roof section are assembled by a process comprising the steps of: (1) cutting at least one first mortise into the first side wall, the first end wall, the second side wall, the second end wall, the first roof section, and the second roof section; (2) cutting a first member from the stock material, wherein the length of the first member is at least the distance between the first mortise in the first end wall, the second side wall, the second end wall, the first roof section, or the second roof section, and the first mortise in an adjacent wall or section; (3) cutting at least one first tenon on the left side of the first member and at least one second tenon on the right side of the first member such that the first tenon protrudes from an edge on the left side of the first member and the second tenon protrudes from an edge on the right side of the first member, wherein the size and shape of the first tenon and the second tenon correspond to the size and shape of the first mortise such that the first tenon and the second tenon each fit within the first mortise, and the first tenon and the second tenon are each comprised of a distal end, a left side and a right side; (4) cutting a second mortise in the distal end of the first tenon and a third mortise in the distal end of the second tenon; (5) cutting locking pegs from the stock material corresponding in size and shape to the second mortise and the third mortise such that each locking peg fits within the second mortise and within the third mortise, and the locking pegs comprise a top portion, a bottom portion, and two side portions; (6) inserting at least one first tenon into the first mortise of a wall or section; (7) inserting at least second tenon into the first mortise of an adjacent wall or section; and (8) inserting one locking peg into the second mortise and one locking peg into the third mortise.

The stock material may include any material used in the fields of carpentry, masonry, or metal work, such as wood, plywood, plastics, metals, natural materials, synthetic materials, composites, medium density fiberboard, and other building materials.

The shelter of the present invention includes a plurality of panels, including, the first side wall, the first end wall, the second side wall, the second end wall, the first roof section, and the second roof section. Furthermore, the first side wall, the first end wall, the second side wall, the second end wall, the first roof section, and the second roof section may each consist of one or more panels. For example, in a preferred embodiment of the instant invention, the first end wall and the second end wall are each comprised of 4 panels. However, it is understood by one of ordinary skill in the art that the first side wall, the first end wall, the second side wall, the second end wall, the first roof section, and the second roof section may all be comprised of any number of panels, without departing from the spirit of the instant invention.

In one embodiment of the instant invention, the first side wall, the first end wall, the second side wall, and/or the second end wall, may include one or more window openings. In another embodiment of the present invention, the first side wall, the first end wall, the second side wall, and/or the second end wall, may include one or more door openings. In a preferred embodiment of the present invention, the first side wall, the first end wall, the second side wall, and/or the second end wall include one or more ventilation holes.

In one particular embodiment of the present invention, the first mortise is a through mortise, wherein the first mortise passes entirely through the first side wall, the first end wall, the second side wall, the second end wall, the first roof section, or the second roof section. The first side wall, the first end wall, the second side wall, the second end wall, the first roof section, and the second roof section can be any shape or form, as long as the size and shape of the first mortise corresponds to the size and shape of the first tenon and the second tenon, such that a secure mortise and tenon joint is formed when the first tenon is inserted into the first mortise or the second tenon is inserted into the first mortise.

In one particular embodiment of the instant invention, the first mortise, the first member, the first tenon, the second tenon, the second mortise the third mortise, and the locking pegs are formed using a rotary cutting tool such as a Computer Numerical Controlled Router (CNC Router) or similar device. It is recognized by one of ordinary skill in the art that using a rotary cutting tool to cut or form the first mortise results in a first mortise having rounded corners. In a preferred embodiment of the instant invention, the radius of the rounded corners in the first mortise is at least half the diameter of the end mill used to cut or form the first mortise. For example, if the end mill diameter is ½ inch, the radius of the corners of the first mortise is at least ¼ inch. Likewise, using a rotary cutting tool to cut or form the second mortise and the third mortise results in a second mortise and a third mortise which each have rounded corners. Accordingly, the radius of the rounded corners in the second mortise and the third mortise are at least half the diameter of the end mill used to cut or form the second mortise and the third mortise.

In a preferred embodiment of the instant invention, the second mortise and the third mortise each have a width equal to the thickness of the first side wall, the first end wall, the second side wall, the second end wall, the first roof section, or the second roof section. For example, if the first side wall, the first end wall, the second side wall, the second end wall, the first roof section, and the second roof section are all one inch thick, the second mortise and the third mortise are both one inch wide.

In another embodiment of the instant invention, the locking pegs have ends which are rounded, which facilitates insertion of the locking peg into the second mortise and the third mortise. However, it is understood by one of ordinary skill in the art that the locking peg may include ends which are not rounded, without departing from the spirit of the instant invention. The corner radius of the locking peg is at least one half of the diameter of the inside corner radius of the second mortise, so that the locking peg may fit tightly into the second mortise. Likewise, the corner radius of the locking peg is at least one half of the diameter of the inside corner radius of the third mortise, so that the locking peg may fit tightly into the third mortise. In one particular embodiment of the instant invention, the locking peg has edges which are also rounded. However, it is understood by one of ordinary skill in the art that the locking peg may include edges which are not rounded, without departing from the spirit of the instant invention. In another embodiment of the instant invention, the locking peg includes a stop (or notch) which prevents the locking peg from being driven in too far or falling out when the locking peg is inserted into the second mortise or the third mortise. In other words, the stop will control the depth that the locking peg is inserted into the second mortise or the third mortise.

In a preferred embodiment of the instant invention, the planar portion of the first tenon and the planar portion of the second tenon are both rounded at the top. However, it is understood by one of ordinary skill in the art that the planar portion of the first tenon and the planar portion of the second tenon may be any shape, depending on the user's specific requirements. The bottom of the planar portion of the first tenon is vertical, forming a first tenon shoulder. The first tenon shoulders counteract lateral forces and aid in securing the first tenon within the first mortise. In a preferred embodiment of the instant invention, the first tenon includes shoulders which are flat. Likewise, the bottom of the planar portion of the second tenon is vertical, forming a second tenon shoulder. The second tenon shoulders counteract lateral forces and aid in securing the second tenon within the first mortise. In a preferred embodiment of the instant invention, the second tenon includes shoulders which are flat.

Furthermore, the edge of the rounded planar portion of the first tenon is also rounded, to facilitate insertion of the first tenon into the first mortise. However, it is understood by one of ordinary skill in the art that the edge of the rounded planar portion of the first tenon may be any shape, depending on the user's specific requirements. Likewise, the edge of the rounded planar portion of the second tenon is also rounded, to facilitate insertion of the second tenon into the first mortise. However, it is understood by one of ordinary skill in the art that the edge of the rounded planar portion of the second tenon may be any shape, depending on the user's specific requirements In one particular embodiment of the present invention, the first tenon contains an undercut below the bottom of the planar portion of the first tenon. The undercut is formed to cut away the first tenon shoulder such that the first mortise will seat against the horizontal plane of the first tenon, and eliminate any stress riser which can result in a crack or help weaken any sharply angled corner under the load. In a preferred embodiment of the instant invention, the combined height of the undercut in the first tenon and the first tenon shoulder is equal to the thickness of the first side wall, the first end wall, the second side wall, the second end wall, the first roof section, or the second roof section so as to avoid any gaps between the first side wall, the first end wall, the second side wall, the second end wall, the first roof section, or the second roof section and the first tenon. However, it is understood by one of ordinary skill in the art that the combined height of the undercut in the first tenon and the first tenon shoulder may be more or less than the thickness of the first side wall, the first end wall, the second side wall, the second end wall, the first roof section, or the second roof section, without departing from the spirit of the instant invention. Likewise, in one particular embodiment of the present invention, the second tenon contains an undercut below the bottom of the planar portion of the second tenon. The undercut is formed to cut away the second tenon shoulder such that the first mortise will seat against the horizontal plane of the second tenon, and eliminate any stress riser which can result in a crack or help weaken any sharply angled corner under the load. In a preferred embodiment of the instant invention, the combined height of the undercut in the second tenon and the second tenon shoulder is equal to the thickness of the first side wall, the first end wall, the second side wall, the second end wall, the first roof section, or the second roof section so as to avoid any gaps between the first side wall, the first end wall, the second side wall, the second end wall, the first roof section, or the second roof section and the second tenon. However, it is understood by one of ordinary skill in the art that the combined height of the undercut in the second tenon and the second tenon shoulder may be more or less than the thickness of the first side wall, the first end wall, the second side wall, the second end wall, the first roof section, or the second roof section, without departing from the spirit of the instant invention.

In one embodiment of the present invention, the first tenon is disposed at one end of the first member, wherein the first tenon is at least ⅓ the thickness of the first side wall, the first end wall, the second side wall, the second end wall, the first roof section, or the second roof section. However, it is understood by one of ordinary skill in the art that the first tenon may be less than ⅓ the thickness of the first side wall, the first end wall, the second side wall, the second end wall, the first roof section, or the second roof section, and still result in a strong and effective joint. Likewise, in one embodiment of the present invention, the second tenon is disposed at one end of the first member, wherein the second tenon is at least ⅓ the thickness of the first side wall, the first end wall, the second side wall, the second end wall, the first roof section, or the second roof section. However, it is understood by one of ordinary skill in the art that the first tenon may be less than ⅓ the thickness of the first side wall, the first end wall, the second side wall, the second end wall, the first roof section, or the second roof section, and still result in a strong and effective joint.

In another preferred embodiment of the instant invention, there is a 90 degree angle between the first tenon and the first mortise, once the first tenon is inserted into the first mortise. However, it is understood by one of ordinary skill in the art that the angle between the first tenon and the first mortise once the first tenon is inserted into the first mortise may be more or less than 90 degrees depending on the user's specific requirements. In order to attach the first side wall, the first end wall, the second side wall, the second end wall, the first roof section, or the second roof section to the first member at different angles of attachment, the first mortise may be beveled such that the first tenon may be inserted into the first mortise at the angle desired. Likewise, in another preferred embodiment of the instant invention, there is a 90 degree angle between the second tenon and the first mortise, once the second tenon is inserted into the first mortise. However, it is understood by one of ordinary skill in the art that the angle between the second tenon and the first mortise once the second tenon is inserted into the first mortise may be more or less than 90 degrees depending on the user's specific requirements. In order to attach the first side wall, the first end wall, the second side wall, the second end wall, the first roof section, or the second roof section to the first member at different angles of attachment, the first mortise may be beveled such that the second tenon may be inserted into the first mortise at the angle desired.

In one particular embodiment of the instant invention, the first side wall, the first end wall, the second side wall, and the second end wall each have at least one tenon on the top edge thereof. The first roof section has at least one mortise at the portion of the first roof section where the first roof section meets the first end wall, the first side wall, and the second end wall, such that the at least one tenon in the first end wall, the first side wall, and the second end wall may be inserted into the at least one tenon of the first roof section, to further secure the first roof section. Likewise, the second roof section has at least one mortise at the portion of the second roof section where the second roof section meets the first end wall, the second side wall, and the second end wall, such that the at least one tenon in the first end wall, the second side wall, and the second end wall may be inserted into the at least one tenon of the second roof section, to further secure the second roof section.

In another preferred embodiment of the present invention, the first side wall, the first end wall, the second side wall, the second end wall, the first roof section, the second roof section, the first member, and the locking pegs are all the same thickness. However, it is understood by one of ordinary skill in the art that the first side wall, the first end wall, the second side wall, the second end wall, the first roof section, the second roof section, the first member, and the locking pegs need not be the same thickness, as long as the first tenon and the second tenon may be inserted into the first mortise in the first side wall, the first end wall, the second side wall, the second end wall, the first roof section, or the second roof section, and the locking pegs may be inserted into the second mortise and the third mortise. Indeed, if the first side wall, the first end wall, the second side wall, the second end wall, the first roof section, the second roof section, the first member, and the locking pegs are different thicknesses, dimensional details of the mortise and tenon joints must be changed accordingly.

In a preferred embodiment of the instant invention, the first end wall, the second side wall, and the second end wall each contain interlocking finger members on at least one side thereof to connect the first side wall to the first end wall, the first end wall to the second side wall, the second side wall to the second end wall, and the second end wall to the first side wall, wherein a side of the first end wall, the second side wall, and the second end wall with interlocking finger members interlocks with the interlocking finger members of an adjacent wall. In addition to connecting one wall with an adjacent wall, the interlocking finger members function to absorb shear forces between one wall and an adjacent wall. The first roof section and the second roof section each contain interlocking finger members on at least one side thereof to connect the first roof section to the second wall section, wherein a side of the first roof section with interlocking finger members interlocks with the interlocking finger members on the second roof section. In addition to connecting the first roof section and the second roof section, the interlocking finger members function to absorb shear forces between the first roof section and the second roof section.

The mortise and tenon joints of the present invention can be further secured by the use of glue, pins or wedges. In one particular embodiment of the present invention, a peg or pin is inserted into the second mortise, to maintain the first tenon within the first mortise. In other words, the first tenon extends into the first mortise leaving at least a portion of the distal end of the first tenon exposed on the first side wall, the first end wall, the second side wall, the second end wall, the first roof section, or the second roof section. Likewise, in one particular embodiment of the present invention, a peg or pin is inserted into the third mortise, to maintain the second tenon within the first mortise. In other words, the second tenon extends into the first mortise leaving at least a portion of the distal end of the second tenon exposed on the first side wall, the first end wall, the second side wall, the second end wall, the first roof section, or the second roof section.

To assemble the mortise and tenon joint of the instant invention, only one tool is required, a hammer. In a preferred embodiment of the instant invention, the thickness of the head and handle of the hammer is the same as the thickness of the first side wall, the first end wall, the second side wall, the second end wall, the first roof section, the second roof section, and the first member. Accordingly, the hammer, the first side wall, the first end wall, the second side wall, the second end wall, the first roof section, the second roof section, and the first member may all be cut from the same material. It is understood that forming the hammer from the same material that is used to form the first side wall, the first end wall, the second side wall, the second end wall, the first roof section, the second roof section, and the first member assures that the hammer and the mortise and tenon joint will have the same relative size, thickness, hardness and specific gravity such that the hammer will not have a tendency to mark or dent the components of the mortise and tenon joint during assembly. However, it is understood by one of ordinary skill in the art that the thickness of the head and handle of the hammer is not required to be the same as the thickness of the first side wall, the first end wall, the second side wall, the second end wall, the first roof section, the second roof section, or the first member, and will still function effectively. The hammer includes two striking surfaces. In another preferred embodiment of the instant invention, at least one of the two striking surfaces is rounded to prevent damage to the components of the mortise and tenon joint during the assembly thereof. Further, the hammer may include rounded shoulders or corners, also to prevent damage to the components of the mortise and tenon joint during the assembly thereof.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements through the several views.

DETAILED DESCRIPTION OF THE PREFERRED EMBODIMENTS

Figure 1:
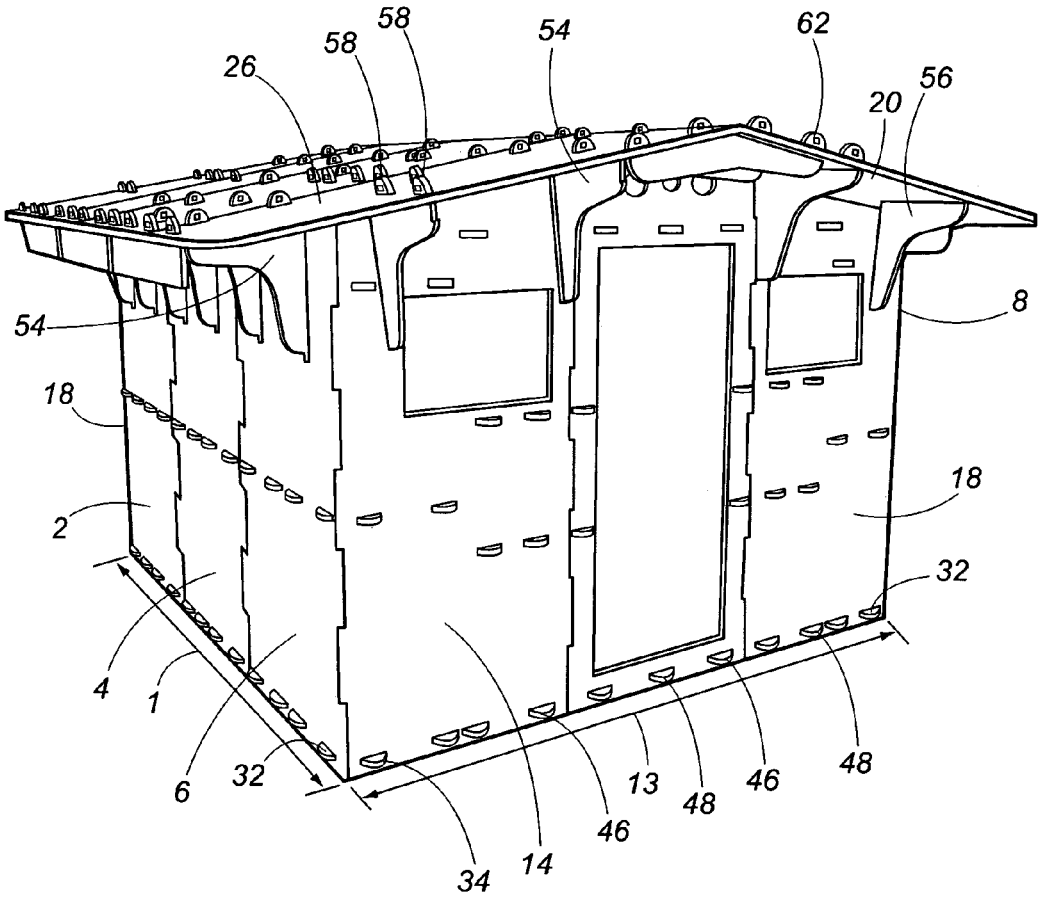
FIG. 1 is an environmental view of one embodiment of the present invention, showing the front and one side of the shelter of the present invention.
Figure 2:
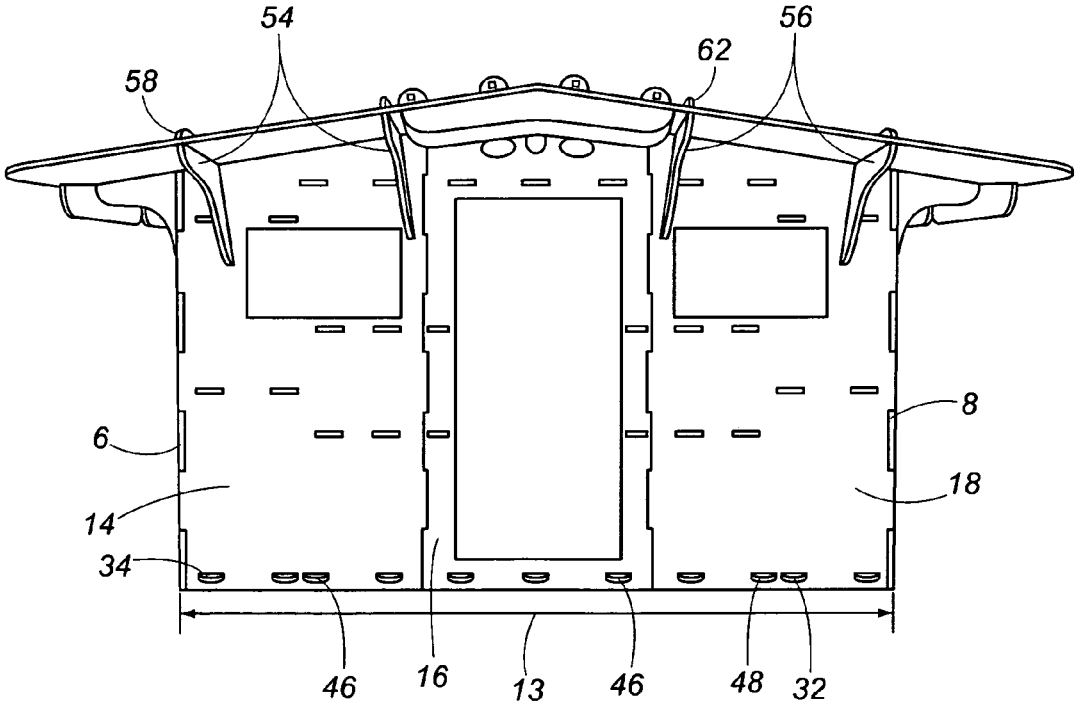
FIG. 2 is an environmental view of one embodiment of the present invention, showing the front of the shelter of the present invention.
Figure 3:
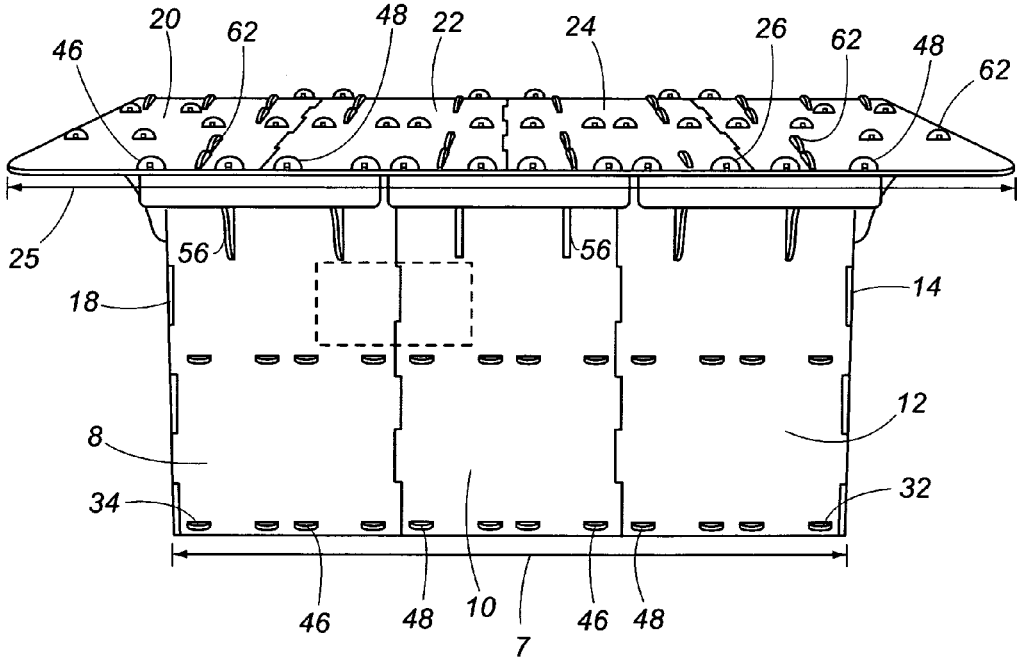
FIG. 3 is an environmental view of one embodiment of the present invention, showing one side of the shelter of the present invention.
Figure 6:
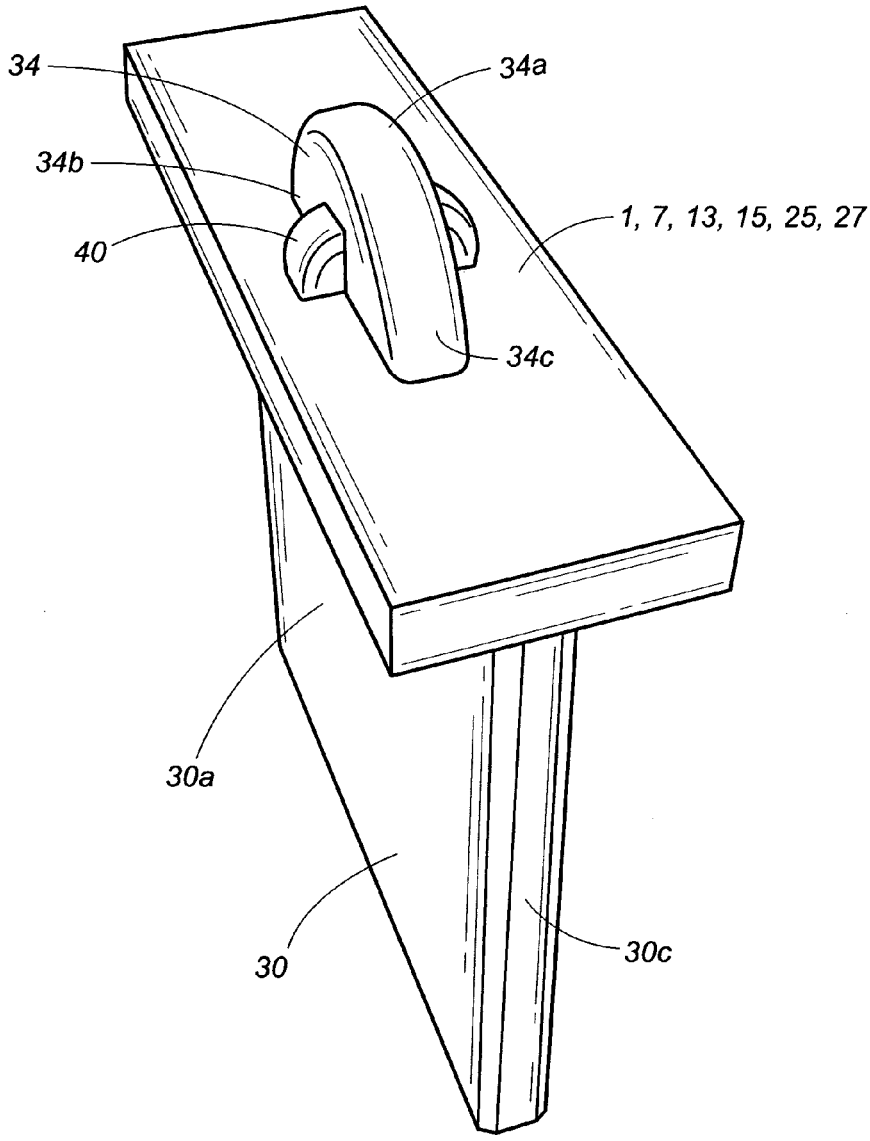
FIG. 6 is an environmental view of one embodiment of the present invention, showing two structures to be joined to one another using a mortise and tenon joint.

In accordance with the instant invention, FIGS. 1-4 show a modular shelter comprising a first side wall 1, a second side wall 7 (as shown in FIG. 3), a first end wall 13, and a second end wall 15 (not shown), such that first side wall 1 and first end wall 13, first end wall 13 and second side wall 7, second side wall 7 and second end wall 15, and second end wall 15 and first side wall 1 are disposed at an angle between 60 and 120 degrees relative to one another and are connected by at least two mortise and tenon joints, such as the mortise and tenon joint shown in FIG. 6. In one particular embodiment of the instant invention, first side wall 1, second side wall 7, first end wall 13, and second end wall 15 are each cut from a stock material. In a preferred embodiment of the present invention, first side wall 1 and first end wall 13, first end wall 13 and second side wall 7, second side wall 7 and second end wall 15, and second end wall 15 and first side wall 1 are disposed at a 90 degree angle relative to one another.

Figure 5:
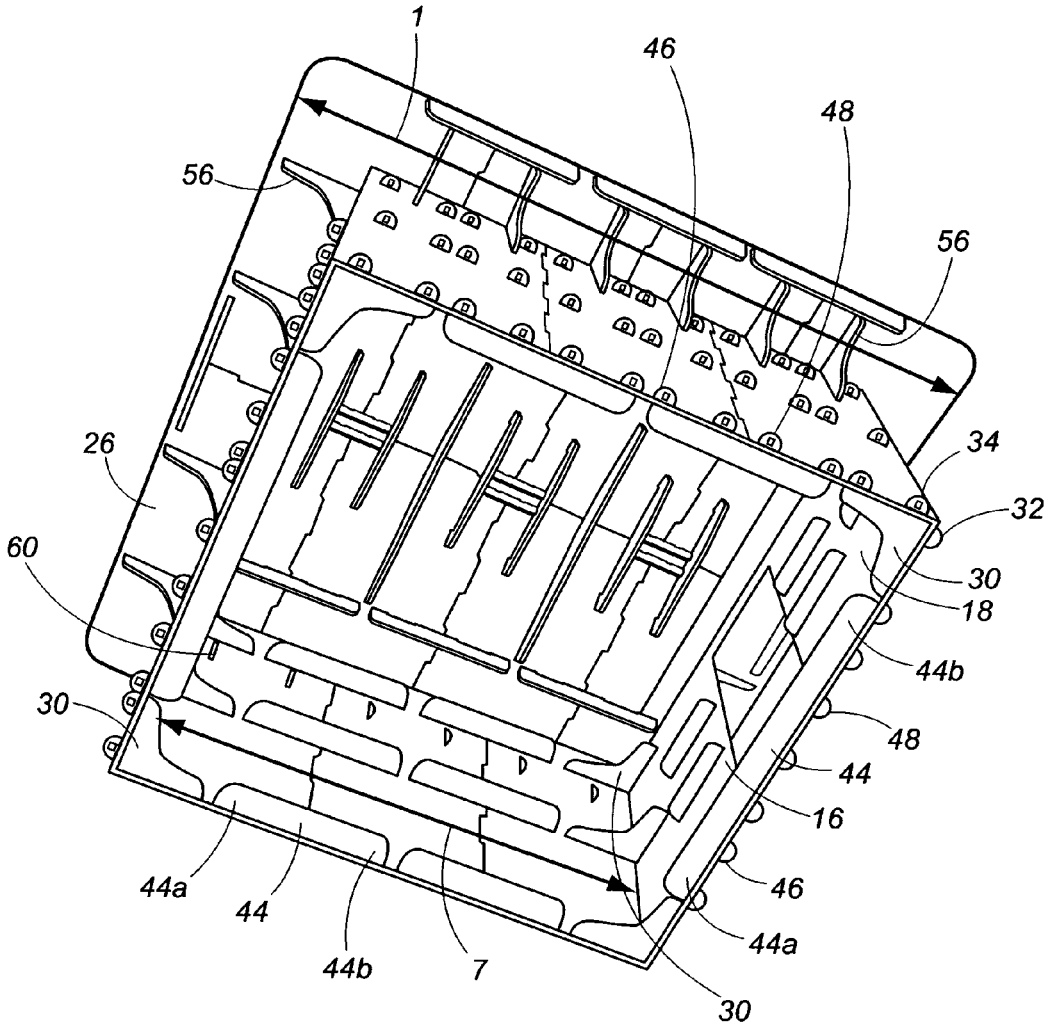
FIG. 5 is a bottom view of one embodiment of the shelter of the present invention

When first side wall 1 and first end wall 13, first end wall 13 and second side wall 7, second side wall 7 and second end wall 15, and second end wall 15 and first side wall 1 are connected by mortise and tenon joints, first side wall 1, second side wall 7, first end wall 13, and the second end wall 15 (not shown) form a quadrilateral, as shown in FIG. 5. One of ordinary skill in the art recognizes that additional walls may be added to first side wall 1, second side wall 7, first end wall 13, and the second end wall so as to form a pentagon, hexagon, or any other polygon.

The modular shelter further comprises a first roof section 25, and a second roof section 27 cut from the stock material, such that first roof section 25 and second roof section 27 are disposed at an angle between 45 and 180 degrees relative to one another and are connected by at least two mortise and tenon joints, such as the mortise and tenon joint shown in FIG. 6. In a preferred embodiment of the instant invention, first roof section 25 and second roof section 27 are disposed at an angle between 120 and 150 degrees relative to one another. The angle between first roof section 25 and second roof section 27 will depend on, among other things, the distance between first side wall 1 and second side wall 7.

Figure 7:
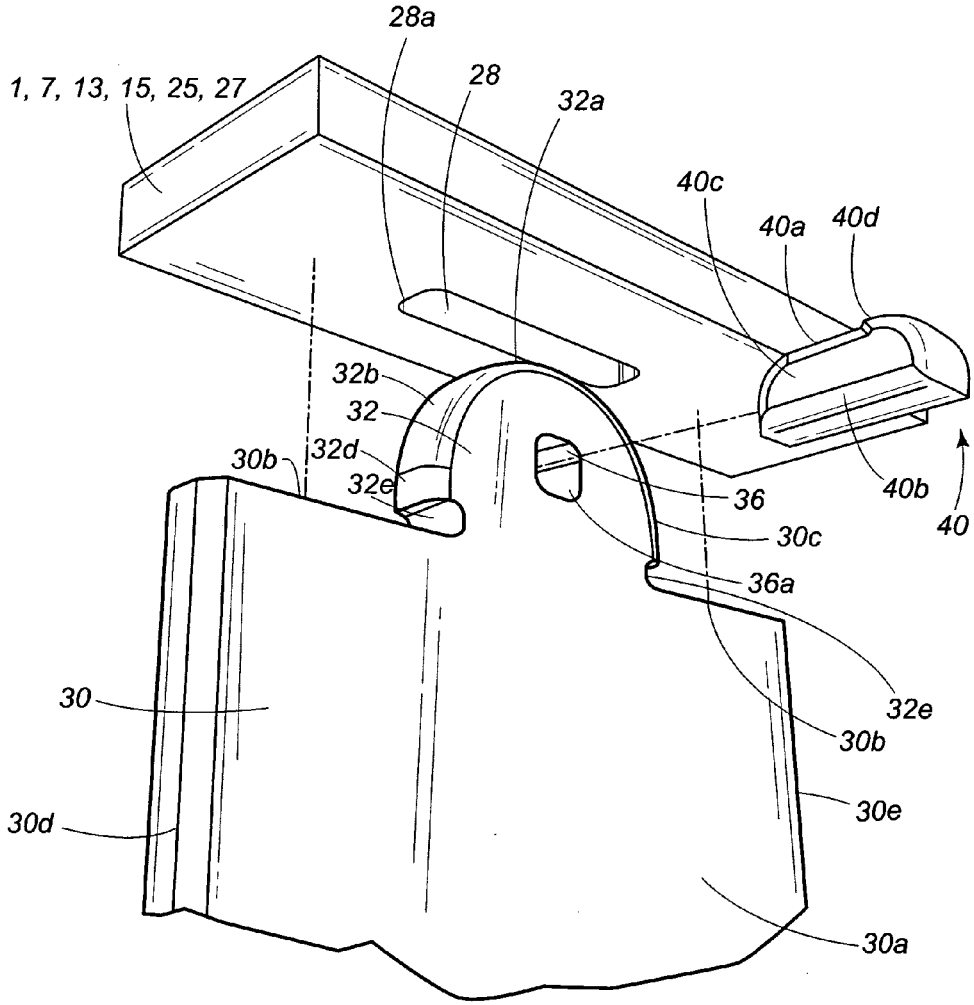
FIG. 7 is an environmental view of one embodiment of the present invention, showing two structures to be joined to one another using a mortise and tenon joint.
Figure 8:
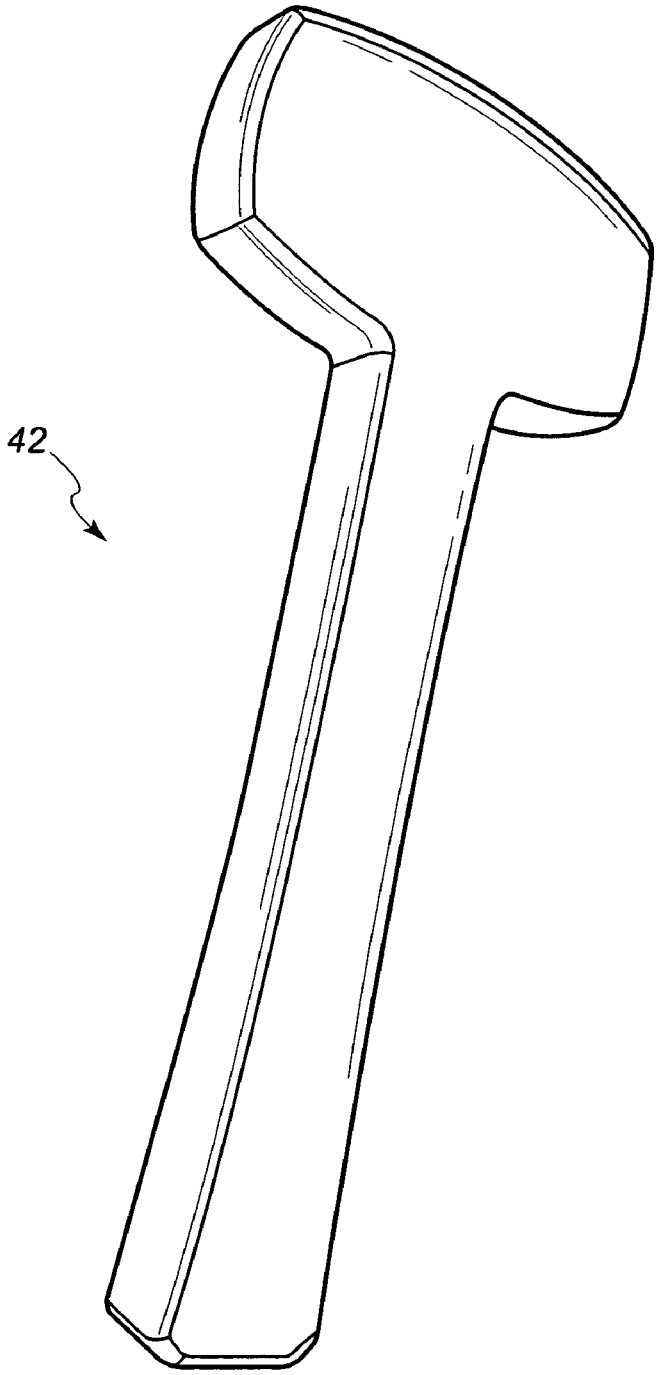
FIG. 8 is an environmental view of the tool used to assemble the mortise and tenon joint, in accordance with one embodiment of the present invention.

As shown in FIGS. 6 and 7, the mortise and tenon joints that connect first side wall 1 and first end wall 13, first end wall 13 and second side wall 7, second side wall 7 and second end wall 15, second end wall 15 and first side wall 1, and first roof section 25 and second roof section 27 are assembled by a process which includes cutting at least one first mortise 28 into first side wall 1, second side wall 7, first end wall 13, second end wall 15, first roof section 25 and second roof section 27 on opposite ends thereof. As used herein, at on opposite ends thereof, shall mean any location to the left and right of the center of first side wall 1, second side wall 7, first end wall 13, second end wall 15, first roof section 25 and second roof section 27.

Next, a first member 30 having a left side 30*a*, a right side (not shown), a left edge 30*b*, a top edge 30*e*, and a bottom edge 30*d* (See FIGS. 6-7) is cut from the stock material, wherein the length of first member 30 is at least the distance between first mortise 28 in first side wall 1, first end wall 13, second side wall 7, second end wall 15, first roof section 25, or second roof section 27, and first mortise 28 in an adjacent wall (such as, for example, first side wall 1, first end wall 13, second side wall 7, or second end wall 15) or section (such as, for example, first roof section 25 and second roof section 27).

After first member 30 is cut from the stock material, at least one first tenon 32 is cut on the left side 30*a* of first member 30 (shown in FIG. 7), and at least one second tenon 34 is cut on the right side of first member 30 (shown in FIG. 6) such that first tenon 32 protrudes from an edge (left edge 30*b*, top edge 30*e*, or bottom edge 30*d*) on left side 30*a* of first member 30 and second tenon 34 protrudes from an edge on the right side of first member 30 (right edge (not shown), top edge 30*e*, or bottom edge 30*d*), wherein the size and shape of first tenon 32 and second tenon 34 correspond to the size and shape of first mortise 28 such that first tenon 32 and second tenon 34 each fit within first mortise 28.

As shown in FIG. 7, first tenon 32 is comprised of a distal end 32*a*, a left side 32*b* and a right side 32*c* (not shown). Likewise, as shown in FIG. 6, second tenon 34 is comprised of a distal end 34*a*, a left side 34*b* and a right side 34*c*. In one embodiment of the instant invention, first tenon 32 and second tenon 34 are identical in size and shape. However, one of ordinary skill in the art will appreciate that first tenon 32 and second tenon 34 may be of different sizes and shapes, depending on, for example, the size and shape of the mortise into which first tenon 32 is inserted and the mortise into which second tenon 34 is inserted.

In a preferred embodiment of the instant invention, first tenon 32 further comprises a vertical shoulder 32*d* on either side of first tenon 32 (shown in FIG. 7), and second tenon 34 (shown in FIG. 6) further comprises a vertical shoulder (not shown) on either side of second tenon 34. It is recognized by one of ordinary skill in the art that vertical shoulder 32*d* and the vertical shoulder either side of second tenon 34 facilitate the insertion of first tenon 32 and second tenon 34 into first mortise 28. In another preferred embodiment of the instant invention, as shown in FIG. 7, first tenon 32 further comprises indents 32*e* on either side of first tenon 32, such that the bottom of indents 32*e* is parallel to the edge of first member 30 from which first tenon 32 protrudes. Second tenon 34 further comprises indents (not shown) on either side of second tenon 34, such that the bottom of the indents is parallel to the edge of first member 30 from which second tenon 34 protrudes. In one particular preferred embodiment of the instant invention, the combined height of vertical shoulder 32*d* of first tenon 32 and indent 32*e* of first tenon 32 is equal to the thickness of the stock material. Likewise, the combined height of vertical shoulder of second tenon 34 and the indent of second tenon 34 is equal to the thickness of the stock material. However, it is recognized by one of ordinary skill in the art that the combined height of vertical shoulder 32*d* of first tenon 32 and indent 32*e* of first tenon 32, and the combined height of the vertical shoulder of second tenon 34 and the indent of second tenon 34, is not required to be equal to the thickness of the stock material, and can vary depending on the desired use, for example.

In accordance with the instant invention, first tenon 32 and second tenon 34 may be disposed along any edge of first member 30, depending on, for example, the location of the first mortise 28 into which first tenon 32 is to be inserted or the location of the first mortise 28 into which second tenon 34 is to be inserted. For example, if the location of the first mortise 28 into which first tenon 32 is to be inserted or the location of the first mortise 28 into which second tenon 34 is to be inserted are at a 90 degree angle, relative to one another, first tenon 32 may protrude from left edge 30*b* of first member 30 and second tenon 34 may protrude from top edge 30*e* or bottom edge 30*d* of first member 30. Conversely, if the location of the first mortise 28 into which first tenon 32 is to be inserted or the location of the first mortise 28 into which second tenon 34 is to be inserted are at a 90 degree angle, relative to one another, first tenon 32 may protrude from top edge 30*e* or bottom edge 30*d* of first member 30 and second tenon 34 may protrude from left edge 30*b* of first member 30.

In the example provided immediately above, first tenon 32 is perpendicular to top edge 30*e* or bottom edge 30*d* of first member 30 and second tenon 34 is perpendicular to left edge 30*b* of first member 30. It is understood by one of ordinary skill in the art that the locations of first tenon 32 and second tenon 34 on first member 30 may be altered to accommodate situations in which the location of the first mortise 28 into which second tenon 34 is to be inserted are at an angle greater or less than 90 degrees, relative to one another, by altering the angle between first tenon 32 and the edge of first member 30 from which first tenon 32 protrudes, and the angle between second tenon 34 and the edge of first member 30 from which second tenon 34 protrudes. For example, if the location of the first mortise 28 into which first tenon 32 is to be inserted or the location of the first mortise 28 into which second tenon 34 is to be inserted are at a 135 degree angle, relative to one another, first tenon 32 may protrude from top edge 30*e* or bottom edge 30*d* of first member 30 at an angle of 45 or 135 degrees, relative to top edge 30*e* or bottom edge 30*d*, and second tenon 34 may protrude from left edge 30*b* of first member 30 such that second tenon 34 is perpendicular to left edge 30*b* of first member 30.

If on the other hand, the location of the first mortise 28 into which first tenon 32 is to be inserted or the location of the first mortise 28 into which second tenon 34 is to be inserted are at a 180 degree angle, relative to one another, first tenon 32 may protrude from left edge 30*b* of first member 30 and second tenon 34 may protrude from the right edge of first member 30 (not shown). If the location of the first mortise 28 into which first tenon 32 is to be inserted or the location of the first mortise 28 into which second tenon 34 is to be inserted are on the same plane, first tenon 32 and second tenon 34 may both protrude from top edge 30*e* of first member 30; or first tenon 32 and second tenon 34 may both protrude from bottom edge 30*d* of first member 30.

In a preferred embodiment of the instant invention, first mortise 28 includes rounded corners 28*a* which have a corner radius which is at least one half of the diameter of the rotary cutting tool used to cut first mortise 28. It is recognized by one of ordinary skill in the art that rounded corners 28*a* will facilitate the insertion of first tenon 32 or second tenon 34, especially where first tenon 32 and second tenon 34 are rounded at the distal ends thereof.

Second mortise 36 is cut in distal end 32*a* of first tenon 32 (see FIG. 7) and third mortise (not shown) is cut in distal end 34*a* of second tenon 34 (see FIG. 6). As shown in FIG. 7, second mortise 36 is disposed an equal distance between the top edge of distal end 34*a* and left edge 30*b* of first member 30. However, it should be recognized that second mortise 36 may be cut on any part of distal end 32*a* of first tenon 32, depending on, for example the size of the locking peg to be inserted into second mortise 36, or the desired location of the locking peg to be inserted into second mortise 36. Likewise, it should be recognized that third mortise 38 may be cut on any part of distal end 34*a* of second tenon 34, depending on, for example the size of the locking peg to be inserted into the third mortise (not shown), or the desired location of the locking peg to be inserted into the third mortise.

In a preferred embodiment of the instant invention, second mortise 36 has rounded corners 36*a* which have a corner radius which is at least one half of the diameter of the rotary cutting tool used to cut second mortise 36, and the third mortise has rounded corners which have a corner radius which is at least one half of the diameter of the rotary cutting tool used to cut the third mortice. It is recognized by one of ordinary skill in the art that rounded corners will facilitate the insertion of locking pegs (discussed below) into second mortise 36 and the third mortise, especially where the locking pegs are rounded.

After second mortise 36 is cut in distal end 32*a* of first tenon 32 and the third mortise (not shown) is cut in distal end 34*a* of second tenon 34, locking pegs 40 are cut from the stock material, such that locking pegs 40 correspond in size and shape to second mortise 36 and the third mortise such that each locking peg 40 fits within second mortise 36 and within the third mortise. However it is recognized by one of ordinary skill in the art that the size and shape of second mortise 36 can be different than the size and shape of the third mortise, depending on, for example, the size and shape of locking pegs 40. For example, locking pegs 40 may be different sizes and shapes. However, the size and shape of second mortise 36 and the size and shape of the third mortise will still conform to the size and shape of the different locking pegs 40 such that one size locking peg 40 corresponds in size and shape to the size and shape of second mortise 36 and another size locking peg 40 corresponds in size and shape to the size and shape of the third mortise.

Locking pegs 40 comprise a top portion 40*a*, a bottom portion 40*b*, and two side portions 40*c*. In particular, the size and shape of locking pegs 40 are configured such that when locking pegs 40 are inserted into second mortise 36 or the third mortise, locking pegs 40 fit within second mortise 36 and the third mortise such that locking pegs 40 are maintained within second mortise 36 or the third mortise and are prevented from falling through second mortise 36 or the third mortise. In one embodiment of the instant invention, locking pegs 40 are tapered such that one end is smaller than second mortise 36 or the third mortise and the opposite end is larger than second mortise 36 or the third mortise, so that the smaller end may be inserted into second mortise 36 or the third mortise, but will be prevented from falling through second mortise 36 or the third mortise due to the larger end of locking pegs 40. In one particular embodiment of the instant invention, locking pegs 40 include a notch 40*d* on top portion 40*a* of locking pegs 40 to control how far locking pegs 40 may be inserted into second mortise 36 or the third mortise. In particular, the height of locking pegs 40 at notch 40*d* is greater than the height of second mortise 36 or the third mortise, such that locking pegs 40 will be prevented from falling through second mortise 36 or the third mortise.

In a preferred embodiment of the instant invention, the corner radius of locking pegs 40 is at least one half the diameter of the inside corner radius of second mortise 36 or the third mortise.

To assemble the mortise and tenon joints of the instant invention, at least one first tenon 32 is inserted into first mortise 28 of a wall (such as, for example, first side wall 1, second side wall 7, first end wall 13, or second end wall 15) or section (such as, for example, first roof section 25 or second roof section 27). At least one second tenon 34 is then inserted into first mortise 28 of an adjacent wall (such as, for example, first side wall 1, second side wall 7, first end wall 13, or second end wall 15) or section (such as, for example, first roof section 25 or second roof section 27). By doing so, first member 30 connects the wall or panel in which first tenon 32 is inserted into and the wall or panel in which second tenon 34 is inserted into. To secure first tenon 32 within first mortise 28 and second tenon 34 within first mortise of an adjacent wall or panel, one locking peg 40 is inserted into second mortise 36 and one locking peg 40 is inserted into the third mortise.

In one particular embodiment of the instant invention, first mortise 28, first tenon 32, second tenon 34, second mortise 36, the third mortise, and locking pegs 40 are cut using a rotary tool. In a preferred embodiment of the instant invention, the rotary cutting tool is a computer numerical controlled router. However, it is understood by one of ordinary skill in the art that first mortise 28, first tenon 32, second tenon 34, second mortise 36, the third mortise, and locking pegs 40 may be cut by any tool suitable for cutting the stock material used.

In another embodiment of the instant invention, a hammer 42 is cut from the stock material from which first mortise 28, first tenon 32, second tenon 34, second mortise 36, the third mortise, and locking pegs 40 are cut. Hammer 42 is used to aid in inserting first tenon 32 into first mortise 28, inserting second tenon 34 into first mortise 28, inserting locking peg 40 into second mortise 36, and inserting locking peg 40 into the third mortise.

In a preferred embodiment of the instant invention, first side wall 1, first end wall 13, the second side wall 7, and the second end wall 15 each contain interlocking finger members on at least one side (edge) thereof to connect first side wall 1 to first end wall 13, first end wall 13 to second side wall 15, second side wall 15 to second end wall 15, and second end wall 15 to first side wall 1, wherein a side of first side wall 1, first end wall 13, the second side wall 7, and the second end wall 15 with interlocking finger members interlocks with the interlocking finger members of an adjacent wall (such as, for example, first side wall 1, first end wall 13, the second side wall 7, or the second end wall 15). In another preferred embodiment of the instant invention, first roof section 25 and second roof section 27 each contain interlocking finger members on at least one side thereof to connect first roof section 25 to second roof section 27, wherein a side of first roof section 25 with interlocking finger members interlocks with the interlocking finger members on second roof section 27. These interlocking joints absorb sheer forces between panels to strengthen the structure.

The mortise and tenon joints used to connect the at least two panels of first side wall 1, first end wall 13, second side wall 7, second end wall 15, first roof section 25, and second roof section 27 are assembled by a first cutting a second member 44 having a left side 44*a* and a right side 44*b* from the stock material (as shown in FIG. 5). In one embodiment of the instant invention, second member 44 is cut from the stock material from which first mortise 28, first tenon 32, second tenon 34, second mortise 36, third mortise 38, locking pegs 40, and hammer 42. The length of second member 44 is at least the distance between first mortise 28 in one panel of first side wall 1, first end wall 13, second side wall 7, second end wall 15, first roof section 25, or second roof section 27, and first mortise 28 in an adjacent panel of first side wall 1, first end wall 13, second side wall 7, second end wall 15, first roof section 25, or second roof section 27.

Figure 4:
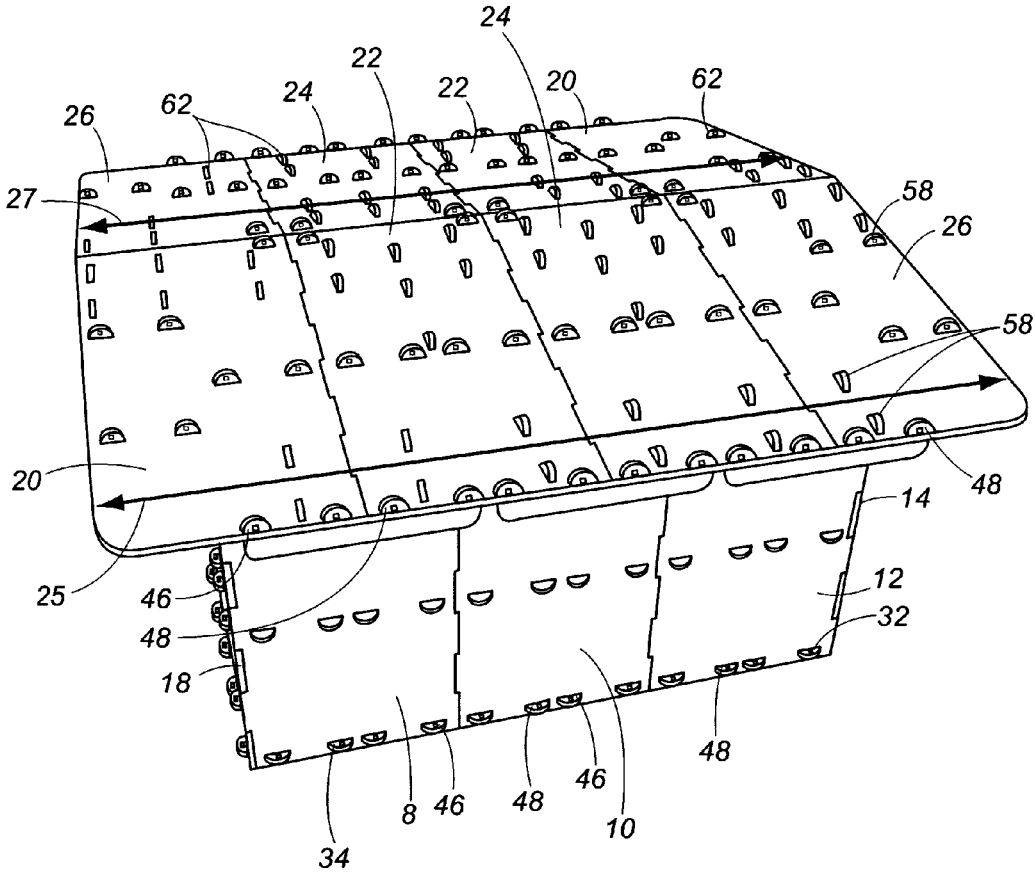
FIG. 4 is a top view of one embodiment of the shelter of the present invention.

In one embodiment of the instant invention, first side wall 1 is comprised of at least two panels, first end wall 13 is comprised of at least two panels, second side wall 7 is comprised of at least two panels, second end wall 15 is comprised of at least two panels, first roof section 25 is comprised of at least two panels, and second roof section 27 is comprised of at least two panels. In particular, the at least two panels of first side wall 1, first end wall 13, second side wall 7, second end wall 15, first roof section 25, and second roof section 27 are disposed at an angle approximately 180 degrees relative to one another and are connected by at least two mortise and tenon joints. First side wall 1 is comprised of three panels: a first side wall panel 2, a second side wall panel 4, and a third side wall 6 (as shown in FIG. 1); first end wall 13 is comprised of three panels: left end wall panel 14, center end wall panel 16, and right end wall panel 18 (as shown in FIG. 2); second side wall 7 is comprised of three panels: fourth side wall panel 8, fifth side wall panel 10, and sixth side wall panel 12 (as shown in FIGS. 3 and 4); second end wall 15 is comprised of three panels: left end wall panel 14, center end wall panel 16, and right end wall panel 18 (not shown); first roof section 25 is comprised of four panels: first end roof panel 20, first center roof panel 22, second center roof panel 24, and second end roof panel 26 (as shown in FIG. 4); and second roof section 27 is comprised of four panels: first end roof panel 20, first center roof panel 22, second center roof panel 24, and second end roof panel 26 (as shown in FIGS. 3 and 4). It is understood by one of ordinary skill in the art that first side wall 1, first end wall 13, second side wall 7, second end wall 15, first roof section 25, and second roof section 27 may be comprised of any number of panels, without departing from the spirit of the instant invention. In one embodiment of the instant invention, the number of panels which comprise first side wall 1, first end wall 13, second side wall 7, second end wall 15, first roof section 25, and second roof section 27, may be varied to shorten or extend the length of first side wall 1, first end wall 13, second side wall 7, second end wall 15, first roof section 25, and second roof section 27.

After second member 44 is cut, at least one third tenon 46 is cut left side 44*a* of second member 44 and at least one fourth tenon 48 is cut on right side 44*b* of second member 44 such that third tenon 46 protrudes an edge on left side 44*a* of second member 44 and fourth tenon 48 protrudes from the edge on right side 44*b* of second member 44 that third tenon 46 protrudes from.

In one embodiment of the instant invention, the size and shape of third tenon 46 and fourth tenon 48 correspond to the size and shape of first mortise 28 such that third tenon 46 and fourth tenon 48 each fit within first mortise 28. Third tenon 46 comprises a distal end, a left side; and a right side. Likewise, fourth tenon 46 comprises a distal end, a left side and a right side. After the third tenon 46 and the fourth tenon 48 are cut from the stock material, a forth mortise is cut in the distal end of third tenon 46 and a fifth mortise is cut in the distal end of the fifth tenon. Locking pegs 40 are then cut from the stock material, wherein locking pegs 40 correspond in size and shape to the fourth mortise and the fifth mortise such that locking pegs 40 fit within the fourth mortise and within the fifth mortise. To assemble the mortise and tenon joints to connect adjacent panels of first side wall 1, first end wall 13, second side wall 7, second end wall 15, first roof section 25, or second roof section 27, at least one third tenon 46 is into first mortise 28 of a panel on first side wall 1, first end wall 13, second side wall 7, second end wall 15, first roof section 25, or second roof section 27. Then at least one fourth tenon 48 is inserted into first mortise 28 of an adjacent panel. To secure the mortise and tenon joints, one locking peg 40 is inserted into the fourth mortise and one locking peg 40 is inserted into the fifth mortise.

In one embodiment of the instant invention, as shown in FIGS. 1 and 2, the top portion of center end wall panel 16 of first end wall 13 contains left and right sides which each slope upwardly to form a peak. The top portion of left end wall panel 14 of first end wall 13 contains left and right sides wherein the height of the left side is less than the height of the right side, such that the slope of the top portion of left end wall panel of first end wall 13 is parallel to the slope from the left side of the top portion of center end wall panel 16 of first end wall 13 to the peak thereof. The top portion of right end wall panel 18 of first end wall 13 contains left and right sides wherein the height of the right side is less than the height of the left side, such that the slope of the top portion of right end wall panel 18 of first end wall 13 is parallel to the slope from the right side of the top portion of center end wall panel 16 of first end wall 13 to the peak thereof.

In another embodiment of the instant invention, the top portion of center end wall panel 16 of second end wall 15 contains left and right sides which each slope upwardly to form a peak. The top portion of left end wall panel 14 of the second end wall contains left and right sides wherein the height of the left side is less than the height of the right side, such that the slope of the top portion of left end wall panel 14 of second end wall 15 is parallel to the slope from the left side of the top portion of center end wall panel 16 of second end wall 15 to the peak thereof. The top portion of right end wall panel 18 of second end wall 15 contains left and right sides wherein the height of the right side is less than the height of the left side, such that the slope of the top portion of right end wall panel 18 of second end wall 15 is parallel to the slope from the right side of the top portion of center end wall panel 18 of second end wall 15 to the peak thereof.

Accordingly, when first roof section 25 and second roof section 27 are mounted atop first side wall 1, first end wall 13, second side wall 15, and second end wall 15, first roof section 25 will have a slope corresponding to the slope from the left side of the top portion of left end wall panel 14 of first end wall 13 to the right side thereof, which is the same as the slope from the right side of the top portion of right end wall panel 18 of second end wall 15 to the left side thereof. Likewise, second roof section 15 will have a slope corresponding to the slope from the right side of the top portion of right end wall panel 18 of first end wall 13 to the left side thereof, which is the same as the slope from the left side of the top portion of left end wall panel 14 of second end wall 15 to the right side thereof. Although second end wall 15 is not shown in the figures, the components of second end wall 15 are the same as the components as first end wall 13. Hence, first end wall 13 and second end wall 15 both share the same characteristics.

In a preferred embodiment of the instant invention, first roof section 25 is secured to first side wall 1, first end wall 13, and second end wall 15 by at least two mortise and tenon joints, as shown in FIGS. 1 and 2. The mortise and tenon joints are assembled by first cutting at least one third member 54 having a left side, a right side, a top edge and a bottom edge from the stock material. The length of third member 54 is at least the distance between first mortise 28 in first side wall 1, first end wall 13, or second end wall 15, and first mortise 28 in first roof section 25. Next, at least one fifth tenon 58 is cut on the left side of third member 54 and at least one sixth tenon 60 is cut on the right side of third member 54 (as shown in FIG. 5). Fifth tenon 58 protrudes from an edge on the left side of third member 54 and sixth tenon 60 protrudes from an edge on the right side of third member 54. The size and shape of fifth tenon 58 and sixth tenon 60 correspond to the size and shape of first mortise 28 such that fifth tenon 58 and sixth tenon 60 each fit within first mortise 28. Fifth tenon 58 and sixth tenon 60 each comprise a distal end, a left side and a right side. After fifth tenon 58 and sixth tenon 60 are cut, a sixth mortise is cut in the distal end of fifth tenon 58 and a seventh mortise is cut in the distal end of sixth tenon 60. Locking pegs 40 are then cut from the stock material corresponding in size and shape to the sixth mortise and the seventh mortise such that locking pegs 40 fit within the sixth mortise and within the seventh mortise. To assemble the mortise and tenon joints to connect first roof section 25 to first side wall 1, first end wall 13, and second end wall 15, at least one fifth tenon 58 is inserted into first mortise 28 in first side wall 1, first end wall 13, or second end wall 15. Then at least one sixth tenon 60 is inserted into first mortise 28 of first roof section 25. To secure the mortise and tenon joints, one locking peg 40 is inserted into the sixth mortise and one locking peg into the seventh mortise.

In another preferred embodiment of the instant invention, second roof section 27 is secured to first end wall 13, second side wall 7 and second end wall 15 by at least two mortise and tenon joints. The mortise and tenon joints are assembled by cutting a fourth member 56 having a left side, a right side, a top edge and a bottom edge from the stock material. The length of fourth member 56 is at least the distance between first mortise 28 in first end wall 13, second side wall 7, or second end wall 15, and a first mortise 28 in second roof section 27. Next, at least one seventh tenon 62 is cut on the left side of fourth member 56 and at least one eighth tenon (not shown) is cut on the right side of fourth member 56. Seventh tenon 62 protrudes from an edge on the left side of fourth member 56. The seventh tenon protrudes from an edge on the right side of fourth member 56. The size and shape of seventh tenon 62 and the eighth tenon corresponds to the size and shape of first mortise 28 such that seventh tenon 62 and the eighth tenon each fit within first mortise 28. Seventh tenon 62 and the eighth tenon each comprise a distal end, a left side and a right side. After seventh tenon 62 and the eighth tenon are cut, an eighth mortise (not shown) is cut in the distal end of seventh tenon 62 and a ninth mortise (not shown) is cut in the distal end of the eighth tenon. Next, locking pegs 40 are cut from the stock material corresponding in size and shape to the eighth mortise and the ninth mortise such that locking pegs 40 fit within the eighth mortise and within the ninth mortise. To assemble the mortise and tenon joints to connect second roof section 27 to first end wall 13, second side wall 7 and second end wall 15, at least one seventh tenon 62 is inserted into first mortise 28 in first end wall 13, second side wall 7, or second end wall 15. Then at least one eighth tenon into first mortise 28 of second roof section 27. To secure the mortise and tenon joints, one locking peg 40 is inserted into the eighth mortise and one locking peg 40 is inserted into the ninth mortise.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

I claim:

1. A modular shelter made from stock material comprising a first side wall, a first end wall, a second side wall, a second end wall, a first roof section, and a second roof section, such that:

(a) the first side wall and the first end wall, the first end wall and the second side wall, the second side wall and the second end wall, and the second end wall and the first side wall are disposed at an angle between 60 and 120 degrees relative to one another and are connected by at least two mortise and tenon joints; and (b) the first roof section and the second roof section are disposed at an angle between 45 and 180 degrees relative to one another and are connected by at least two mortise and tenon joints; such that there is at least one mortise in the first side wall, the first end wall, the second side wall, the second end wall, the first roof section, and the second roof section;

a first member having a left side, a right side, a left edge, a right edge, a top edge and a bottom edge, wherein the length of the first member is at least the distance between the first mortise in the first end wall, the second side wall, the second end wall, the first roof section, or the second roof section, and the first mortise in an adjacent wall or section; the first member comprising:

at least one first tenon on the left side of the first member and at least one second tenon on the right side of the first member such that the first tenon protrudes from an edge on the left side of the first member and the second tenon protrudes from an edge on the right side of the first member, wherein the size and shape of the first tenon and the second tenon correspond to the size and shape of the first mortise such that the first tenon and the second tenon each fit within the first mortise, and the first tenon and the second tenon are each comprised of a distal end, a left side and a right side;

a second mortise in the distal end of the first tenon and a third mortise in the distal end of the second tenon;

locking pegs corresponding in size and shape to the second mortise and the third mortise such that each locking peg fits within the second mortise and within the third mortise, and the locking pegs comprise a top portion, a bottom portion, and two side portions;

at least one first tenon inserted into the first mortise of a wall or section;

at least second tenon inserted into the first mortise of an adjacent wall or section; and one locking peg inserted into the second mortise and one locking peg into the third mortise, wherein the top portion of the locking peg includes a notch to control how far the locking peg may be inserted into the second mortise or the third mortise, wherein the first tenon further comprises a vertical shoulder on either side of the first tenon, and the second tenon further comprises a vertical shoulder on either side of the second tenon, wherein the first tenon further comprises indents on either side of the first tenon, such that the bottom of the indents is parallel to the edge of the first member from which the first tenon protrudes, and the second tenon further comprises indents on either side of the second tenon, such that the bottom of the indents is parallel to the edge of the first member from which the second tenon protrudes, wherein the combined height of the vertical shoulder of the first tenon and an indent of the first tenon is equal to the thickness of the stock material, and the combined height of the vertical shoulder of the second tenon and an indent of the second tenon is equal to the thickness of the stock material, and wherein the corner radius of the locking pegs is at least one half the diameter of the inside corner radius of the second mortise, and the corner radius of the locking pegs is at least one half the diameter of the inside corner radius of the third mortise, wherein the first side wall, the first end wall, the second side wall, and the second end wall each contain interlocking finger members on at least one side thereof to connect the first side wall to the first end wall, the first end wall to the second side wall, the second side wall to the second end wall, and the second end wall to the first side wall, wherein a side of the first end wall, the second side wall, and the second end wall with interlocking finger members interlocks with the interlocking finger members of an adjacent wall.

2. The modular shelter of claim 1, wherein the first roof section and the second roof section each contain interlocking finger members on at least one side thereof to connect the first roof section to the second roof section, wherein a side of the first roof section with interlocking finger members interlocks with the interlocking finger members on the second roof section.

3. The modular shelter of claim 2, wherein the first side wall is comprised of at least two panels, the first end wall is comprised of at least two panels, the second side wall is comprised of at least two panels, the second end wall is comprised of at least two panels, the first roof section is comprised of at least two panels, and the second roof section is comprised of at least two panels, such that the at least two panels of the first side wall, the first end wall, the second side wall, the second end wall, the first roof section, and the second roof section are disposed at an angle approximately 180 degrees relative to one another and are connected by at least two mortise and tenon joints; wherein, the mortise and tenon joints are assembled by a process comprising the steps of: (1) cutting a second member having a left side and a right side, from the stock material, wherein the length of the second member is at least the distance between the first mortise in one panel of the first side wall, first end wall, the second side wall, the second end wall, the first roof section, or the second roof section, and the first mortise in an adjacent panel; (2) cutting at least one third tenon on the left side of the second member and at least one fourth tenon on the right side of the second member such that the third tenon protrudes from an edge on the left side of the second member and the fourth tenon protrudes from an edge on the right side of the second member, wherein the size and shape of the third tenon and the fourth tenon correspond to the size and shape of the first mortise such that the third tenon and the fourth tenon each fit within the first mortise, and the third tenon and the fourth tenon each tenon comprises a distal end, a left side and a right side; (3) cutting a forth mortise in the distal end of the tenon on the right side of the second member and a fifth mortise in the distal end of the tenon on the right side of the second member; (4) cutting locking pegs from the stock material corresponding in size and shape to the fourth mortise and the fifth mortise such that the locking pegs fits within the fourth mortise and within the fifth mortise, and the locking pegs comprise a top portion, a bottom portion, and two side portions; (5) inserting at least one third tenon on the left side of the second member into the first mortise of a panel on the first end wall, the second side wall, the second end wall, the first roof section, or the second roof section; (6) inserting at least one fourth tenon on the right side of the second member into the first mortise of an adjacent panel; and (7) inserting one locking peg into the fourth mortise and one locking peg into the fifth mortise.

4. The modular shelter of claim 3, wherein:

(a) the top portion of the center end wall of the first end wall contains left and right sides which each slope upwardly to form a peak;

(g) the top portion of the left end wall of the first end wall contains left and right sides wherein the height of the left side is less than the height of the right side, such that the slope of the top portion of the left end wall of the first end wall is parallel to the slope from the left side of the top portion of the center end wall of the first end wall to the peak thereof;

(h) the top portion of the right end wall of the first end wall contains left and right sides wherein the height of the right side is less than the height of the left side, such that the slope of the top portion of the right end wall of the first end wall is parallel to the slope from the right side of the top portion of the center end wall of the first end wall to the peak thereof;

(i) the top portion of the center end wall of the second end wall contains left and right sides which each slope upwardly to form a peak;

(j) the top portion of the left end wall of the second end wall contains left and right sides wherein the height of the left side is less than the height of the right side, such that the slope of the top portion of the left end wall of the second end wall is parallel to the slope from the left side of the top portion of the center end wall of the second end wall to the peak thereof; and (k) the top portion of the right end wall of the second end wall contains left and right sides wherein the height of the right side is less than the height of the left side, such that the slope of the top portion of the right end wall of the second end wall is parallel to the slope from the right side of the top portion of the center end wall of the second end wall to the peak thereof; such that when the first roof section and the second roof section are mounted atop the first side wall, the first end wall, the second side wall, and the second end wall, the first roof section will have a slope corresponding to the slope from the left side of the top portion of the left end wall panel of the first end wall to the right side thereof, which is the same as the slope from the right side of the top portion of the right end wall panel of the second end wall to the left side thereof; and second roof section will have a slope corresponding to the slope from the right side of the top portion of the right end wall panel of the first end wall to the left side thereof, which is the same as the slope from the left side of the top portion of the left end wall panel of the second end wall to the right side thereof.

5. The modular shelter of claim 4, wherein the first roof section is secured to the first side wall, first end wall, and second end wall by at least two mortise and tenon joints;

wherein, the mortise and tenon joints are assembled by a process comprising the steps of: (1) cutting a third member having a left side, a right side, a top edge and a bottom edge from the stock material, wherein the length of the third member is at least the distance between the first mortise in the first side wall, the first end wall, or the second end wall, and a first mortise in the first roof section; (2) cutting at least one fifth tenon on the left side of the third member and at least one sixth tenon on the right side of the third member such that the fifth tenon protrudes from an edge on the left side of the third member and the sixth tenon protrudes from an edge on the right side of the third member, wherein the size and shape of the fifth tenon and the sixth tenon correspond to the size and shape of the first mortise such that the fifth tenon and the sixth tenon each fit within the first mortise, and the fifth tenon and the sixth tenon each comprise a distal end, a left side and a right side; (3) cutting a sixth mortise in the distal end of the fifth tenon and a seventh mortise in the distal end of the sixth tenon; (4) cutting locking pegs from the stock material corresponding in size and shape to the sixth mortise and the seventh mortise such that the locking pegs fit within the sixth mortise and within the seventh mortise, and the locking pegs comprise a top portion, a bottom portion, and two side portions; (5) inserting at least one fifth tenon on the left side of the member into the first mortise in the first side wall, the first end wall, or the second end wall; (6) inserting at least one sixth tenon on the right side of the member into a first mortise of the first roof section; and (7) inserting one locking peg into the sixth mortise and one locking peg into the seventh mortise.

6. The modular shelter of claim 5, wherein the second roof section is secured to the first end wall, the second side wall and the second end wall by at least two mortise and tenon joints; wherein, the mortise and tenon joints are assembled by a process comprising the steps of: (1) cutting a fourth member having a left side, a right side, a top edge and a bottom edge from the stock material, wherein the length of the fourth member is at least the distance between the first mortise in the first side wall, the first end wall, or the second end wall, and a first mortise in the second roof section; (2) cutting at least one seventh tenon on the left side of the fourth member and at least one eight tenon on the right side of the fourth member such that the seventh tenon protrudes from an edge on the left side of the fourth member and the seventh tenon protrudes from an edge on the right side of the fourth member, wherein the size and shape of the seventh tenon and the eighth tenon correspond to the size and shape of the first mortise such that the seventh tenon and the eighth tenon each fit within the first mortise, and the seventh tenon and the eighth tenon each comprise a distal end, a left side and a right side; (3) cutting an eighth mortise in the distal end of the seventh tenon and a ninth mortise in the distal end of the eighth tenon; (4) cutting locking pegs from the stock material corresponding in size and shape to the eighth mortise and the ninth mortise such that the locking pegs fit within the eighth mortise and within the ninth mortise, and the locking pegs comprise a top portion, a bottom portion, and two side portions; (5) inserting at least one seventh tenon into the first mortise in the first end wall, the second side wall, or the second end wall; (6) inserting at least one eighth tenon into a first mortise of the second roof section; and (7) inserting one locking peg into the eighth mortise and one locking peg into the ninth mortise.

* * * * *